US010831158B2

(12) United States Patent
Sakumoto

(10) Patent No.: US 10,831,158 B2
(45) Date of Patent: Nov. 10, 2020

(54) TIMEPIECE, MOTOR CONTROL DEVICE, CONTROL METHOD OF TIMEPIECE, AND MOTOR CONTROL METHOD

(71) Applicant: Seiko Instruments Inc., Chiba (JP)

(72) Inventor: Kazumi Sakumoto, Chiba (JP)

(73) Assignee: SEIKO INSTRUMENTS INC., Chiba (JP)

( * ) Notice: Subject to any disclaimer, the term of this patent is extended or adjusted under 35 U.S.C. 154(b) by 400 days.

(21) Appl. No.: 15/933,850

(22) Filed: Mar. 23, 2018

(65) Prior Publication Data

US 2018/0292790 A1 Oct. 11, 2018

(30) Foreign Application Priority Data

Apr. 7, 2017 (JP) ..... 2017-076636

(51) Int. Cl.
*G04C 9/08* (2006.01)
*G04C 99/00* (2006.01)
*G04C 3/14* (2006.01)

(52) U.S. Cl.
CPC ..... *G04C 9/08* (2013.01); *G04C 3/14* (2013.01); *G04C 3/143* (2013.01); *G04C 3/146* (2013.01); *G04C 99/00* (2013.01)

(58) Field of Classification Search
CPC ... G04C 1/00; G04C 3/00; G04C 9/00; G04C 10/00; G04C 13/00; G04C 17/00; G04C 19/00; G04C 21/00; G04C 23/00; G04C 9/08; G04C 99/00; G04C 3/14; G04C 3/16; H02P 1/00; H02P 8/40; H02P 5/68; H02P 8/00; H02P 7/00; H02P 6/00; H02P 3/00; G05B 2219/41326; G05B 19/40; G05B 24/00; G08C 19/20; G04B 19/04
USPC .... 318/34, 685, 696, 400.01, 700, 701, 721, 318/779, 799, 430, 599; 368/28, 37, 80, 368/220
See application file for complete search history.

(56) References Cited

U.S. PATENT DOCUMENTS 5,751,664 A * 5/1998 Higuchi ..... G04C 3/008 368/112
6,278,661 B1 * 8/2001 Higuchi ..... G04C 17/0066 368/28
2010/0220559 A1 9/2010 Galie et al.

FOREIGN PATENT DOCUMENTS

JP 201516996 A 7/2012

* cited by examiner

*Primary Examiner* — Antony M Paul
(74) *Attorney, Agent, or Firm* — Brinks Gilson & Lione

(57) ABSTRACT

A timepiece includes a motor control unit driving a motor for driving an indicating hand, based on an instruction signal, and a control unit receiving an instruction confirmation signal corresponding to a drive state of the motor in response to the instruction signal from the motor control unit, and determining whether or not the motor is driven in accordance with the instruction signal, based on the instruction confirmation signal.

9 Claims, 7 Drawing Sheets

TIMEPIECE, MOTOR CONTROL DEVICE, CONTROL METHOD OF TIMEPIECE, AND MOTOR CONTROL METHOD

RELATED APPLICATIONS

This application claims priority under 35 U.S.C. § 119 to Japanese Patent Application No. 2017-076636 filed on Apr. 7, 2017, the entire content of which is hereby incorporated by reference.

BACKGROUND OF THE INVENTION

Field of the Invention

The present invention relates to a timepiece, a motor control device, a control method of a timepiece, and a motor control method.

Background Art

An analog electronic timepiece has been proposed in which a motor, a train wheel, a dial, and an indicating hand are integrated with each other so as to form a module structure (for example, refer to JP-T-2012-516996). In this electronic timepiece, a controller has a microprocessor or a motor drive circuit, and drives a motor of a module.

A single phase stepping motor for normal rotation driving is used for this electronic timepiece. Therefore, in order to reversely rotate the motor, the stepping motor is driven to reversely rotate by means of pulse control. In this case, based on a pulse length, the motor is driven to normally rotate using a signal cycle of 64 Hz, and is driven to reversely rotate using a signal cycle of 32 Hz.

SUMMARY OF THE INVENTION

However, according to a technique disclosed in JP-T-2012-516996, it is difficult to drive the motor with desired accuracy. For example, in a case where driving control is performed using a plurality of the motors, a control unit (controller) cannot recognize a situation as to which of the motors succeeds or fails in driving. Consequently, when a motor control signal is generated, the situation cannot be reflected.

The present invention is made in view of the above-described problem, and an object thereof is to provide a timepiece, a motor control device, a control method of a timepiece, and a motor control method, which enables a control unit side to recognize and control a drive state of a motor in a timepiece in which the control unit and the motor is separated from each other.

According to an aspect of the present invention, in order to achieve the above-described object, there is provided a timepiece including a motor control unit driving a motor for driving an indicating hand, based on an instruction signal, and a control unit receiving an instruction confirmation signal corresponding to a drive state of the motor in response to the instruction signal from the motor control unit, and determining whether or not the motor is driven in accordance with the instruction signal, based on the instruction confirmation signal.

In the timepiece according to the aspect of the present invention, the motor control unit may include a motor drive state determination circuit determining the drive state of the motor, and an instruction confirmation circuit generating an instruction confirmation signal. In a case where the motor is driven and the instruction signal is input to the motor, the instruction confirmation circuit may generate a first instruction confirmation signal. In a case where the motor is not driven and the instruction signal is input to the motor, or in a case where the motor is driven or is not driven and the instruction signal is not input to the motor, the instruction confirmation circuit may generate a second instruction confirmation signal. In a case where the control unit receives the first instruction confirmation signal, the control unit may determine that the motor is not driven in accordance with the instruction signal.

In the timepiece according to the aspect of the present invention, the motor control unit may drive a plurality of the motors. The instruction signal may be a command for driving a plurality of the motors. The motor control unit may generate the instruction confirmation signal corresponding to each drive state of a plurality of the motors in response to the instruction signal.

In the timepiece according to the aspect of the present invention, the motor control unit may drive the plurality of motors. The instruction signal may be a command for driving a plurality of the motors. The motor control unit may include a motor drive state determination circuit determining the drive state of the motor, and an instruction confirmation circuit generating an instruction confirmation signal. In a case where the motors are driven and the instruction signal is input to any one motor of a plurality of the motors, the instruction confirmation circuit may generate a first instruction confirmation signal. In a case where the motors are not driven and the instruction signal is input to all motors of a plurality of the motors, or in a case where at least one of the motors is driven or is not driven and the instruction signal is not input to the motor, the instruction confirmation circuit may generate a second instruction confirmation signal. In a case where the control unit receives the first instruction confirmation signal, the control unit may determine that at least one of a plurality of the motors is not driven due to the command.

In the timepiece according to the aspect of the present invention, the instruction signal may include information relating to a type of the motor to be driven and a direction for driving the indicating hand. At least one of the control unit and the motor control unit may include a drive pulse generation circuit that sets a drive frequency so as to vary depending on any one of the type of the motor and the direction for driving the indicating hand.

In the timepiece according to the aspect of the present invention, the motor control unit may be included in a support body separate from the control unit and detachably attached to the timepiece.

In the timepiece according to the aspect of the present invention, the instruction confirmation signal may be connected via a single wire connected to the control unit and the motor control unit.

In the timepiece according to the aspect of the present invention, the control unit may output a gate signal allowing the instruction signal. The motor control unit may generate the instruction confirmation signal in response to at least one of a start time and an end time of the gate signal.

According to another aspect of the present invention, in order to achieve the above-described object, there is provided a motor control device including a motor drive state determination circuit determining a drive state of a motor, and an instruction confirmation circuit generating an instruction confirmation signal indicating a state where the motor is driven based on an instruction signal. In a case where the motor is driven and the instruction signal is input to the motor, the instruction confirmation circuit generates a first reception confirmation signal. In a case where the motor is not driven and the instruction signal is input to the motor, or in a case where the motor is driven or is not driven and the instruction signal is not input to the motor, the instruction confirmation circuit generates a second reception confirmation signal.

According to another aspect of the present invention, in order to achieve the above-described object, there is provided a control method of a timepiece having a motor control unit and a control unit. The control method includes causing the motor control unit to drive a motor for driving an indicating hand, based on an instruction signal, and causing the control unit to receive an instruction confirmation signal corresponding to a drive state of the motor in response to the instruction signal from the motor control unit, and to determine whether or not the motor is driven in accordance with the instruction signal, based on the instruction confirmation signal.

According to another aspect of the present invention, in order to achieve the above-described object, there is provided a motor control method of a motor control device including a motor drive state determination circuit determining a drive state of a motor, and an instruction confirmation circuit generating an instruction confirmation signal indicating a state where the motor is driven based on an instruction signal. The motor control method includes causing the instruction confirmation circuit to generate a first reception confirmation signal, in a case where the motor is driven and the instruction signal is input to the motor, and causing the instruction confirmation circuit to generate a second reception confirmation signal, in a case where the motor is not driven and the instruction signal is input to the motor, or in a case where the motor is driven or is not driven and the instruction signal is not input to the motor.

According to the present invention, a control unit side can recognize and control a drive state of a motor in a timepiece in which the control unit and the motor is separated from each other.

DETAILED DESCRIPTION OF THE INVENTION

Hereinafter, an embodiment according to the present invention will be described with reference to the drawings. A timepiece according to the embodiment represents an analog electronic timepiece having an indicating hand, a smart watch (multifunctional wristwatch), a wearable terminal, and instruments. Hereinafter, in the embodiment, an example will be described in which the timepiece is a smart watch including three indicating hands.

Figure 1:
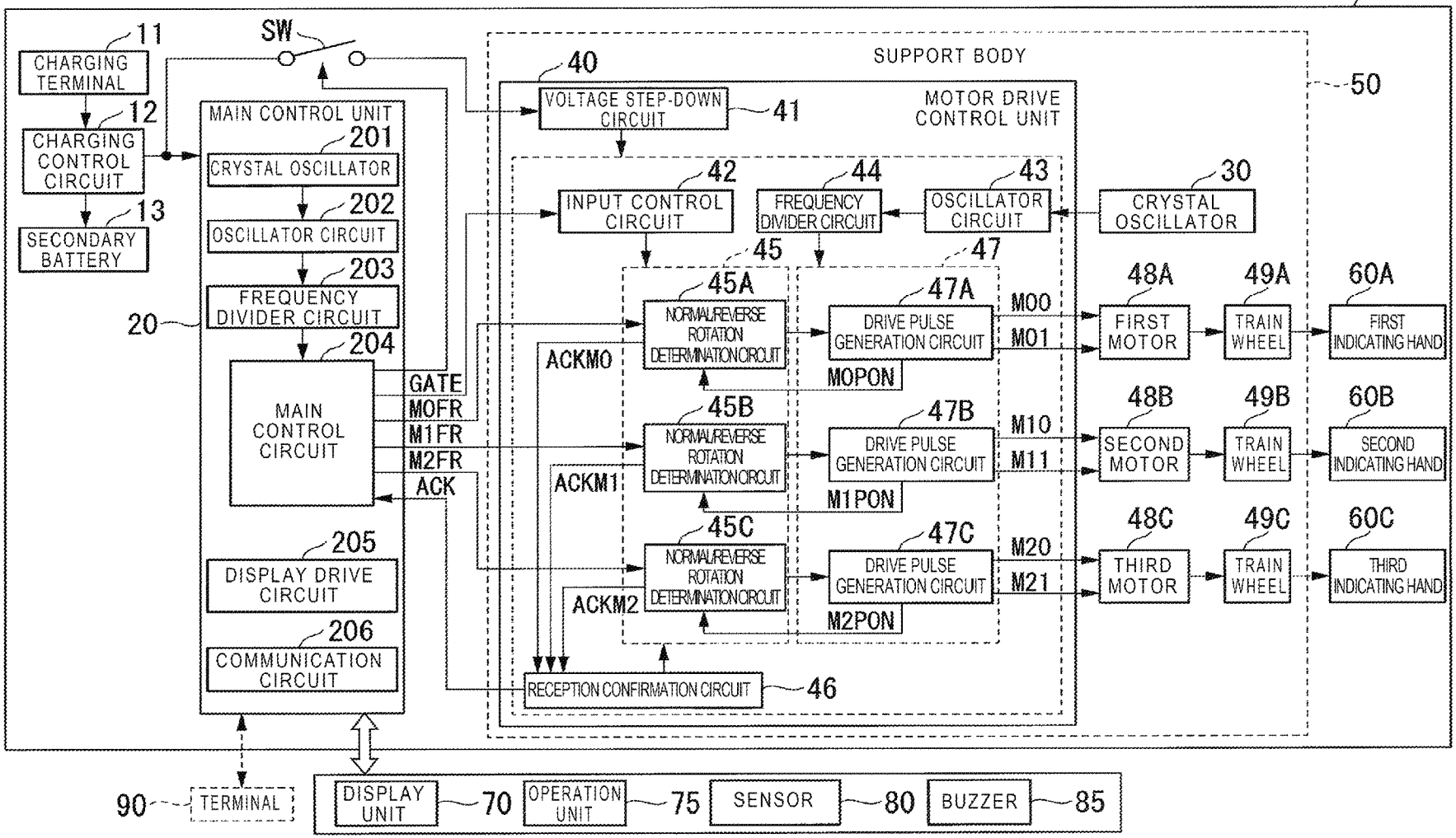
FIG. 1 is a block diagram illustrating a configuration example of a timepiece according to the present embodiment.

FIG. 1 is a block diagram illustrating a configuration example of a timepiece 1 according to the present embodiment.

As illustrated in FIG. 1, the timepiece 1 includes a charging terminal 11, a charging control circuit 12, a secondary battery 13, a switch SW, a main control unit 20, a support body 50, a first indicating hand 60A, a second indicating hand 60B, a third indicating hand 60C, a display unit 70, an operation unit 75, a sensor 80, and a buzzer 85. In a case where one of the first indicating hand 60A, the second indicating hand 60B, and the third indicating hand 60C is not specified, all of these are collectively referred to as an indicating hand 60. The support body 50 is configured to have a form of a separate unit which is easily attachable to and detachable from the timepiece 1, and this form can be referred to as a so-called cassette type or a cartridge type.

The main control unit 20 includes a crystal oscillator 201, an oscillator circuit 202, a frequency divider circuit 203, a main control circuit 204 (control unit), a display drive circuit 205, and a communication circuit 206.

A crystal oscillator 30, a motor drive control unit 40, a first motor 48A, a second motor 48B, a third motor 48C, a train wheel 49A, a train wheel 49B, and a train wheel 49C are attached to the support body 50. In a case where one of the first motor 48A, the second motor 48B, and the third motor 48C is not specified, all of these are collectively referred to as a motor 48.

The motor drive control unit 40 (motor control device) includes a voltage step-down circuit 41, an input control circuit 42, an oscillator circuit 43, a frequency divider circuit 44 (drive pulse generation circuit), a normal/reverse rotation determination circuit 45 (a motor drive state determination circuit and a motor control unit), a reception confirmation circuit 46 (an instruction confirmation circuit and a motor control unit), a drive pulse generation circuit 47 (a motor control unit, and a motor drive state determination circuit, and a drive pulse generation circuit). The normal/reverse rotation determination circuit 45 includes a normal/reverse rotation determination circuit 45A, a normal/reverse rotation determination circuit 45B, and a normal/reverse rotation determination circuit 45C. The drive pulse generation circuit 47 includes a drive pulse generation circuit 47A, a drive pulse generation circuit 47B, and a drive pulse generation circuit 47C.

In the embodiment, a configuration including the normal/reverse rotation determination circuit 45, the reception confirmation circuit 46, and the drive pulse generation circuit 47 is referred to as a motor control unit.

The timepiece 1 displays a time by using the first indicating hand 60A to the third indicating hand 60C during a clocking operation. The timepiece 1 communicates with a terminal 90 via a wired or wireless network so as to transmit and receive information. For example, the timepiece 1 transmits a detection value detected by the sensor 80, residual quantity information indicating residual quantity of the secondary battery, to the terminal 90 via the network. For example, the timepiece 1 receives time information from the terminal 90, and corrects the clocked time in accordance with the received time information. The timepiece 1 receives an operation instruction from the terminal 90, and controls the first indicating hand 60A to the third indicating hand 60C to be driven in accordance with the received operation instruction.

The terminal 90 is a device having a communication function, for example, a smartphone, a tablet terminal, a portable game machine, and a computer. For example, the terminal 90 is configured to include an operation unit, a display unit, a control unit, a global positioning system (GPS), a communication unit, and a battery. The terminal 90 transmits time information acquired using the GPS, an operation instruction, residual quantity information of the battery of the terminal itself to the timepiece 1 via the network. In addition, the terminal 90 receives the detection value transmitted by the timepiece 1, and the residual quantity information via the network, and displays the received information on the display unit.

A circuit board 10 (substrate) (base) is a base to which the main control unit 20 and the support body 50 are attached. The charging terminal 11, the charging control circuit 12, the secondary battery 13, the main control unit 20, and the support body 50 are attached to the circuit board 10.

The charging terminal 11 receives power supply from the outside, and is a universal serial bus (USB) terminal, for example. The charging terminal 11 supplies the supplied power to the charging control circuit 12.

The charging control circuit 12 charges the secondary battery 13 with the power supplied from the charging terminal 11. The charging control circuit 12 supplies the power stored in the secondary battery 13 to the main control unit 20 and the motor drive control unit 40 attached to the support body 50.

The secondary battery 13 is a lithium ion polymer battery, for example.

The main control unit 20 controls each configuration element included in the timepiece 1. The main control unit 20 causes the display unit 70 to display information. The information to be displayed is the residual quantity of the secondary battery 13, for example. In addition, the main control unit 20 acquires an operation result obtained by a user operating the operation unit 75, and controls each configuration element included in the timepiece 1 in accordance with the acquired operation result. In addition, the main control unit 20 acquires the detection value output by the sensor 80.

The crystal oscillator 201 is a passive element used for oscillating a first frequency from its mechanical resonance by utilizing a piezoelectric phenomenon of quartz. Here, the first frequency is 100 MHz, for example.

The oscillator circuit 202 is a circuit for realizing an oscillator by being combined with the crystal oscillator 201, and outputs a signal of the generated first frequency to the frequency divider circuit 203.

The frequency divider circuit 203 divides the signal of the first frequency output by the oscillator circuit 202 into a desired frequency, and outputs a frequency-divided signal to the main control circuit 204.

The main control circuit 204 is operated at the timing of the signal based on the first frequency. For example, the main control circuit 204 is a central processing unit (CPU) for a mobile terminal and a wearable terminal, and is a CPU using an ARM architecture, for example. In addition, the main control circuit 204 internally includes a storage unit, and stores a corresponding relationship between an instruction signal and a motor (to be described later), and a definition of the instruction signal (normal rotation instruction by using one pulse and reverse rotation instruction by using two pulses). The main control unit 20 may separately include the storage unit.

At the timing of the signal output by the frequency divider circuit 203, the main control circuit 204 outputs the instruction signal for driving the motor to the motor drive control unit 40. The main control circuit 204 and the motor drive control unit 40 are connected to each other by two control lines (GATE and ACK) and three signal lines (M0FR, M1FR, and M2FR). Each of M0FR, M1FR, and M2FR signals is not only an instruction signal but also a command. In this way, the ACK signal (instruction confirmation signal) is connected via one wire connected to the main control unit 20 (control unit) and the motor drive control unit 40 (motor control unit).

The main control circuit 204 controls each configuration element of the timepiece 1, based on an operation result output by the operation unit 75. For example, the operation result is a time adjustment operation or an alarm operation. In a case of the time adjustment operation, for example, the main control circuit 204 causes the third indicating hand 60C to move to a position of 12 o'clock, and stops the third indicating hand 60C. Furthermore, the main control circuit 204 controls the first indicating hand 60A and the second indicating hand 60B to perform a fast forwarding operation or to perform fast rewinding operation. At the time of the alarm operation, the main control circuit 204 counts signals output by the frequency divider circuit 203, and issues a signal from the buzzer 85 when the set time is up, or when the set time elapses. The main control circuit 204 outputs the instruction signal to the motor drive control unit 40 at the timing of 64 Hz and 32 Hz by using the signal of the frequency output by the frequency divider circuit 203. In a case where the ACK signal (instruction confirmation signal) output by the reception confirmation circuit 46 is in the H-level (second instruction confirmation signal), the main control circuit 204 determines that the motor is driven by the instruction signal. In a case where the ACK signal is in the L-level (first instruction confirmation signal), the main control circuit 204 determines that the motor is not driven by the instruction signal, and outputs the instruction signal to the motor drive control unit 40 again.

The main control circuit 204 controls a state of power supply to the motor drive control unit 40 by switching between an on-state and an off-state of the switch SW. For example, in a case where the residual quantity of the secondary battery 13 is smaller than a predetermined capacity, the main control circuit 204 may perform control so as to reduce intervals for power supply to the motor drive control unit 40 or to stop the power supply. Alternatively, the main control circuit 204 may perform control so as to reduce the intervals for power supply to the motor drive control unit 40 or to stop the power supply, based on the operation instruction received by the communication circuit 206. The switch SW may be configured to include a MOS transistor.

In addition, the main control circuit 204 controls an operation mode of the timepiece 1, based on the operation result output by the operation unit 75 or the operation instruction received by the communication circuit 206. Herein, the operation mode includes a clocking mode (normal operation mode), a chronograph mode, a time adjustment mode, an alarm setting mode, an alarm operation mode, and external control mode. In the external control mode, at least one of the first motor 48A to the third motor 48C is driven in response to the operation instruction output from the terminal 90 so as to move the corresponding indicating hand. As an example, in a case where the terminal 90 transmits the battery residual quantity of the terminal 90 as the operation instruction, the main control circuit 204 may set 0% for the 12 o'clock position, 10% for the 1 o'clock position, . . . , and 100% for the 10 o'clock position, and may control the third indicating hand to present the battery residual quantity of the terminal 90.

Furthermore, the main control circuit 204 may detect the residual quantity of the secondary battery 13. The main control circuit 204 may cause the display drive circuit 205 to display the detected residual quantity information of the secondary battery 13 on the display unit 70. The main control circuit 204 may transmit the detected residual quantity information of the secondary battery 13 to the terminal 90 via the communication circuit 206 and the network.

The display drive circuit 205 causes the display unit 70 to display the display information output by the main control circuit 204. The display drive circuit 205 may be included in the display unit 70.

The communication circuit 206 transmits and receives information to and from the terminal 90 via the network in accordance with the control of the main control circuit 204. For example, the communication circuit 206 employs a communication method using the Wireless Fidelity (Wi-Fi) standard or the Bluetooth (registered trademark) Low Energy (LE) (hereinafter referred to as BLE) standard so as to transmit and receive the instruction or the information to and from the terminal 90. In addition, the communication circuit 206 may acquire the information from the GPS.

The crystal oscillator 30 is a passive element used for causing a second frequency to oscillate. Here, the second frequency is lower than the first frequency, and is 32 Hz or 64 Hz, for example. The frequency of 64 Hz is used for the normal rotation, and the frequency of 32 Hz is used for the reverse rotation.

The motor drive control unit 40 is operated at the timing of a signal based on the second frequency. For example, the motor drive control unit 40 is a motor driver IC (integrated circuit). The motor drive control unit 40 determines whether a control signal output by the main control circuit 204 is a control signal for causing a motor to perform normal rotation or a control signal for causing the motor to perform reverse rotation. Based on the determination result, the motor drive control unit 40 generates a drive pulse, and drives the motor by outputting the generated drive pulse.

The voltage step-down circuit 41 steps down a voltage supplied from the charging control circuit 12 to 1.57 V, for example, and supplies the step-down voltage to each configuration element of the motor drive control unit 40.

A GATE signal is input to the input control circuit 42. The input control circuit 42 outputs a signal indicating a period while the GATE signal is in an H (High) level to the normal/reverse rotation determination circuit 45.

The oscillator circuit 43 realizes an oscillator in combination with the crystal oscillator 30, and outputs a signal of the generated second frequency to the frequency divider circuit 44.

The frequency divider circuit 44 divides a signal of the second frequency output by the oscillator circuit 43 into a desired frequency, and outputs the divided signal to the drive pulse generation circuit 47.

An M0FR signal serving as a first instruction signal is input to the normal/reverse rotation determination circuit 45A. The normal/reverse rotation determination circuit 45A counts the number of periods while the input control circuit 42 outputs a signal indicating the H-level and the number of periods while the M0FR signal is in the H-level. In this manner, the normal/reverse rotation determination circuit 45A determines whether the M0FR signal is a normal rotation instruction signal or a reverse rotation instruction signal. The normal/reverse rotation determination circuit 45A determines that a signal equal to or greater than a threshold value is in the H-level. When the GATE signal is changed from the H-level to the L (low) level, the normal/reverse rotation determination circuit 45A outputs the determination result to the drive pulse generation circuit 47A. The determination result is an instruction to perform either the normal rotation for one step or the reverse rotation for one step. In the present embodiment, the H-level is set as a first level, and the L-level is set as a second level.

In a case where the M0FR signal is input when the M0PON signal output by the drive pulse generation circuit 47A is in the H-level, the normal/reverse rotation determination circuit 45A sets the ACKM0 signal to be in the L-level, and outputs the ACKM0 signal to the reception confirmation circuit 46. In a case where the M0FR signal is input when the M0PON signal is in the L-level, the normal/reverse rotation determination circuit 45A sets the ACKM0 signal to be in the H-level, and outputs the ACKM0 signal to the reception confirmation circuit 46. An ACKMn (n is an integer from 0 to 2) represents a signal indicating whether a command is received when the motor 48 is driven or whether a command is received when the motor 48 is not driven. In addition, the M0PON signal indicates a state where the drive pulse generation circuit 47A drives the first motor 48A. The M0PON signal is in the H-level while the first motor 48A is driven, and is in the L-level while the first motor 48A is stopped. In addition, the ACKM0 signal is in the L-level in a case where the instruction signal is input while the first motor 48A is driven, and is in the H-level in other cases. The other cases include a case where the first motor 48A is not driven and the instruction signal is input, or a case where the first motor 48A is driven or not driven and the instruction signal is not input.

In accordance with a state of the M0PON signal output by the drive pulse generation circuit 47A and an output of the reception confirmation circuit 46, the normal/reverse rotation determination circuit 45A determines whether or not to receive the instruction of the M0FR signal. Specifically, the normal/reverse rotation determination circuit 45A does not receive the instruction of the M0FR signal in a case where the M0PON signal indicates that the first motor 48A is driven. In addition, the normal/reverse rotation determination circuit 45A does not receive the instruction of the M0FR signal, when the reception confirmation circuit 46 outputs an instruction not to receive the instruction of an MnFR signal (n is an integer of 0 to 2), even in a case where the M0PON signal indicates that the first motor 48A is not driven. On the other hand, in a case where the M0PON signal indicates that the first motor 48A is not driven, the normal/reverse rotation determination circuit 45A receives the instruction of the M0FR signal.

The M1FR signal serving as a second instruction signal is input to the normal/reverse rotation determination circuit 45B. While the input control circuit 42 outputs the signal indicating the H-level, the normal/reverse rotation determination circuit 45B counts the number of periods during which the M1FR signal is in the H-level. In this manner, it is determined whether the M1FR signal is the normal rotation instruction signal or the reverse rotation instruction signal. When the GATE signal is changed from the H-level to the L-level, the normal/reverse rotation determination circuit 45B outputs a determination result to the drive pulse generation circuit 47B. In a case where the M1FR signal is input when the M1PON signal output by the drive pulse generation circuit 47B is in the H-level, the normal/reverse rotation determination circuit 45B sets the ACKM1 signal to be in the L-level, and outputs the ACKM1 signal to the reception confirmation circuit 46. In a case where the M1FR signal is input when the M1PON signal is in the L-level, the normal/reverse rotation determination circuit 45B sets the ACKM1 signal to be in the H-level, and outputs the ACKM1 signal to the reception confirmation circuit 46. The M1PON signal indicates a state where the drive pulse generation circuit 47B drives the second motor 48B. The M1PON signal is in the H-level while the second motor 48B is driven, and is in the L-level while the second motor 48B is stopped. In addition, the ACKM1 signal is in the L-level in a case where the instruction signal is input while the second motor 48B is driven, and is in the H-level in other cases. The other cases include a case where the second motor 48B is not driven and the instruction signal is input, or a case where the second motor 48B is driven or not driven and the instruction signal is not input. The normal/reverse rotation determination circuit 45B determines whether or not to receive the instruction of the M1FR signal in accordance with the state of the M1PON signal output by the drive pulse generation circuit 47B and the output of the reception confirmation circuit 46.

The M2FR signal serving as a third instruction signal is input to the normal/reverse rotation determination circuit 45C. While the input control circuit 42 outputs the signal indicating the H-level, the normal/reverse rotation determination circuit 45C counts the number of periods during which the M2FR signal is in the H-level. In this manner, it is determined whether the M2FR signal is the normal rotation instruction signal or the reverse rotation instruction signal. When the GATE signal is changed from the H-level to the L-level, the normal/reverse rotation determination circuit 45C outputs the determination result to the drive pulse generation circuit 47C. In a case where the M2FR signal is input when the M2PON signal output by the drive pulse generation circuit 47C is in the H-level, the normal/reverse rotation determination circuit 45C sets the ACKM2 signal to be in the L-level, and outputs the ACKM2 signal to the reception confirmation circuit 46. In a case where the M2FR signal is input when the M2PON signal is in the L-level, the normal/reverse rotation determination circuit 45C sets the ACKM2 signal to be in the H-level, and outputs the ACKM2 signal to the reception confirmation circuit 46. The M2PON signal indicates a state where the drive pulse generation circuit 47C drives the third motor 48C. The M2PON signal is in the H-level while the third motor 48C is driven, and is in the L-level while the third motor 48C is stopped. In addition, the ACKM2 signal is in the L-level in a case where the instruction signal is input while the third motor 48C is driven, and is in the H-level in other cases. The other cases include a case where the third motor 48C is not driven and the instruction signal is input, or a case where the third motor 48C is driven or not driven and the instruction signal is not input. The normal/reverse rotation determination circuit 45C determines whether or not to receive the instruction of the M2FR signal in accordance with the state of the M2PON signal output by the drive pulse generation circuit 47C and the output of the reception confirmation circuit 46.

The ACKM0 signal is input to the reception confirmation circuit 46 from the normal/reverse rotation determination circuit 45A, the ACKM1 signal is input to the reception confirmation circuit 46 from the normal/reverse rotation determination circuit 45B, and the ACKM2 signal is input to the reception confirmation circuit 46 from the normal/reverse rotation determination circuit 45C. In a case where at least one of ACKMn (n is an integer from 0 to 2) signals is in the L-level, the reception confirmation circuit 46 does not receive the command, outputs an instruction not to receive the instruction of the MnFR signal (n is an integer of 0 to 2) to the normal/reverse rotation determination circuit 45, and outputs the ACK signal in the L-level to the main control circuit 204. In a case where all of the ACKMn (n is an integer from 0 to 2) signals are in the H-level, the reception confirmation circuit 46 outputs the ACK signal in the H-level to the main control circuit 204.

Based on the determination result output by the normal/reverse rotation determination circuit 45A, the drive pulse generation circuit 47A generates pulse signals M00 and M01 for causing the first motor 48A to perform the normal rotation for one step or the reverse rotation for one step. The drive pulse generation circuit 47A drives the first motor 48A by using the generated pulse signals M00 and M01. The drive pulse generation circuit 47A switches the M0PON signal between the H-level and the L-level, based on a drive state of the first motor 48A, and outputs the switched M0PON signal to the normal/reverse rotation determination circuit 45A.

Based on the determination result output by the normal/reverse rotation determination circuit 45B, the drive pulse generation circuit 47B generates pulse signals M10 and M11 for causing the second motor 48B to perform the normal rotation for one step or the reverse rotation for one step. The drive pulse generation circuit 47B drives the second motor 48B by using the generated pulse signals M10 and M11. The drive pulse generation circuit 47B switches the M1PON signal between the H-level and the L-level, based on a drive state of the second motor 48B, and outputs the switched M1PON signal to the normal/reverse rotation determination circuit 45B.

Based on the determination result output by the normal/reverse rotation determination circuit 45C, the drive pulse generation circuit 47C generates pulse signals M20 and M21 for causing the third motor 48C to perform the normal rotation for one step or the reverse rotation for one step. The drive pulse generation circuit 47C drives the third motor 48C by using the generated pulse signals M20 and M21. The drive pulse generation circuit 47C switches the M2PON signal between the H-level and the L-level, based on a drive state of the third motor 48C, and outputs the switched M2PON signal to the normal/reverse rotation determination circuit 45C.

The first motor 48A, the second motor 48B, and the third motor 48C are respectively stepping motors.

The first motor 48A drives the first indicating hand 60A via the train wheel 49A by using the pulse signals M00 and M01 output by the drive pulse generation circuit 47A. The second motor 48B drives the second indicating hand 60B via the train wheel 49B by using the pulse signals M10 and M11 output by the drive pulse generation circuit 47B. The third motor 48C drives the third indicating hand 60C via the train wheel 49C by using the pulse signals M20 and M21 output by the drive pulse generation circuit 47C.

Each of the train wheels 49A, 49B, and 49C is configured to include at least one gear.

For example, the first indicating hand 60A is an hour hand, and is rotatably supported by the support body 50. For example, the second indicating hand 60B is a minute hand, and is rotatably supported by the support body 50. For example, the third indicating hand 60C is a second hand, and is rotatably supported by the support body 50.

As an example, the display unit 70 is a liquid crystal display (LCD). For example, the display unit 70 displays the residual quantity information of the secondary battery 13 under the control of the main control circuit 204. For example, the display unit 70 may display an operation mode of the timepiece 1 under the control of the main control circuit 204.

The operation unit 75 is configured to include at least one button or crown. The operation unit 75 detects an operation result operated by a user, and outputs the detected operation result to the main control circuit 204. The operation unit 75 may be a touch panel sensor disposed in the display unit 70 or glass on the dial. In addition, the operation unit 75 may detect that the buzzer 85 is tapped, and may use the detection result as an operation result. A signal applied to the buzzer 85, which is a piezoelectric element, is detected using the method of the invention disclosed in JP-A2014-139542, for example.

The sensor 80 is at least one of an acceleration sensor, a geomagnetic sensor, an atmospheric pressure sensor, a temperature sensor, and an angular velocity sensor. The sensor 80 outputs the detection value to the main control circuit 204. The main control circuit 204 uses a detection value of the acceleration sensor so as to detect the inclination of the timepiece 1. For example, the acceleration sensor is a three-axis sensor, which detects gravitational acceleration. The main control circuit 204 uses a detection value of the geomagnetic sensor so as to detect a direction of the timepiece 1. The main control circuit 204 uses a detection value of atmospheric pressure sensor for a barometer or an altimeter. The main control circuit 204 uses a detection value of the angular velocity sensor (gyro sensor) so as to detect the rotation of the timepiece 1.

The buzzer 85 is a piezoelectric element, which issues an alarm in accordance with the control of the main control circuit 204.

Description of Arrangement on Circuit Board 10

Next, an example will be described in which the charging terminal 11, the charging control circuit 12, the secondary battery 13, the main control unit 20, and the support body 50 are arranged on the circuit board 10. The arrangement example illustrated in FIG. 2 is merely an example, and the arrangement on the circuit board 10 in the timepiece 1 is not limited thereto.

Figure 2:
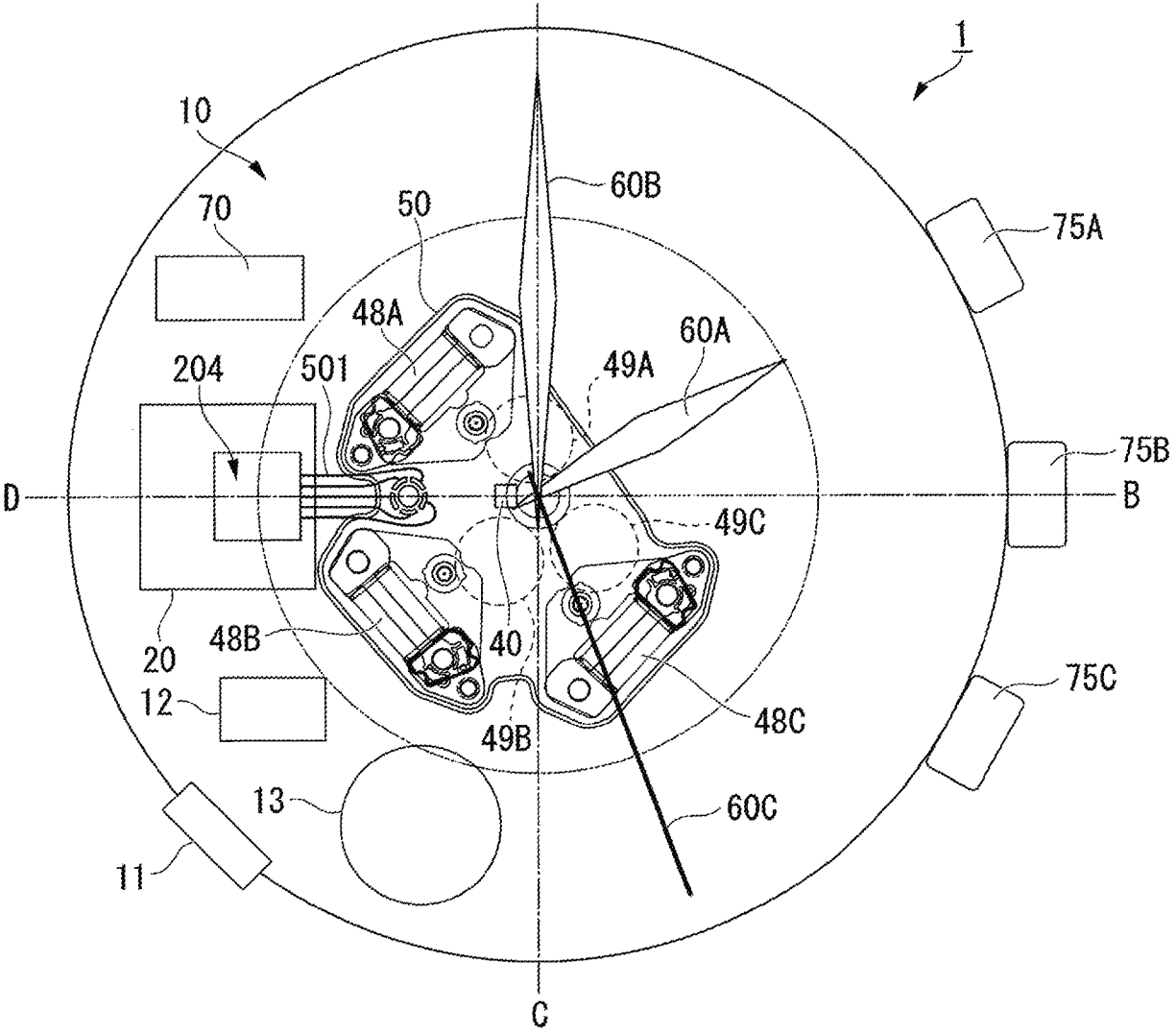
FIG. 2 illustrates an example in which a charging terminal, a charging control circuit, a secondary battery, a main control unit, and a support body are arranged on a circuit board according to the present embodiment.

FIG. 2 is a view illustrating an example in which the charging terminal 11, the charging control circuit 12, the secondary battery 13, the main control unit 20, and the support body 50 are arranged on the circuit board 10 according to the present embodiment. In FIG. 2, a position A to a position D around the timepiece centered on a line AB are respectively referred to as a 12 o'clock position, a 3 o'clock position, a 6 o'clock position, and a 9 o'clock position. As illustrated in FIG. 2, on the circuit board 10, the support body 50 is disposed substantially at the center, the main control unit 20 is disposed approximately at the 9 o'clock position, and the display unit 70 is disposed approximately at the 11 o'clock position. The main control circuit 204 and the motor drive control unit 40 are connected to each other by two control lines (GATE and ACK) and three signal lines (M0FR, M1FR, and M2FR) as indicated by the reference numeral 501. In the example illustrated in FIG. 2, the support body 50 includes a connector 511, and the main control circuit 204 and five signal lines are connected to the connector 511. In this case, the connector 511 and the motor drive control unit 40 are connected to each other by a wiring material disposed on the support body 50.

In addition, operation units 75A to 75C are arranged approximately at the 2 o'clock to 4 o'clock positions on the right side of the circuit board 10. The secondary battery 13 is disposed approximately at the 7 o'clock position on the lower left side of the circuit board 10. The charging control circuit 12 and the charging terminal 11 are arranged approximately at the 8 o'clock position.

In addition, the motor drive control unit 40, the first motor 48A, the second motor 48B, the third motor 48C, the train wheel 49A, the train wheel 49B, and the train wheel 49C are attached onto the support body 50. Furthermore, the first indicating hand 60A, the second indicating hand 60B, and the third indicating hand 60C are attached to the support body 50.

In the example illustrated in FIGS. 1 and 2, an example has been described in which three sets of motor control unit (the normal/reverse rotation determination circuit and the drive pulse generation circuit) and three motors are arranged on the support body 50. However, the configuration is not limited thereto.

For example, the first support body 50 may include the crystal oscillator 30, the voltage step-down circuit 41, the input control circuit 42, the oscillator circuit 43, the frequency divider circuit 44, the reception confirmation circuit 46, two sets of motor control unit (the normal/reverse rotation determination circuits 45A and 45B and the drive pulse generation circuits 47A and 47B). The second support body 50 may include the crystal oscillator 30, the voltage step-down circuit 41, the input control circuit 42, the oscillator circuit 43, the frequency divider circuit 44, the reception confirmation circuit 46, one set of motor control unit (the normal/reverse rotation determination circuit 45C and the drive pulse generation circuit 47C). In this case, the main control circuit 204 and the first support body may be connected to each other by two control lines (GATE and ACK) and two signal lines (M0FR and M1FR). The main control circuit 204 and the second support body may be connected to each other by two control lines (GATE and ACK) and one signal line (M2FR). Even in this case, the total number of the control lines and the signal lines between the main control circuit 204 and the support body 50 is five. According to this configuration, the indicating hand 60 is more freely disposed on the dial (not illustrated).

Description of Example of Timing of Each Signal

Next, an example of the timing of the GATE signal, the instruction signal, the drive pulse, the ACK signal, the MnPON signal, and the ACKMn signal (n is an integer of 0 to 2) will be described.

Figure 3:
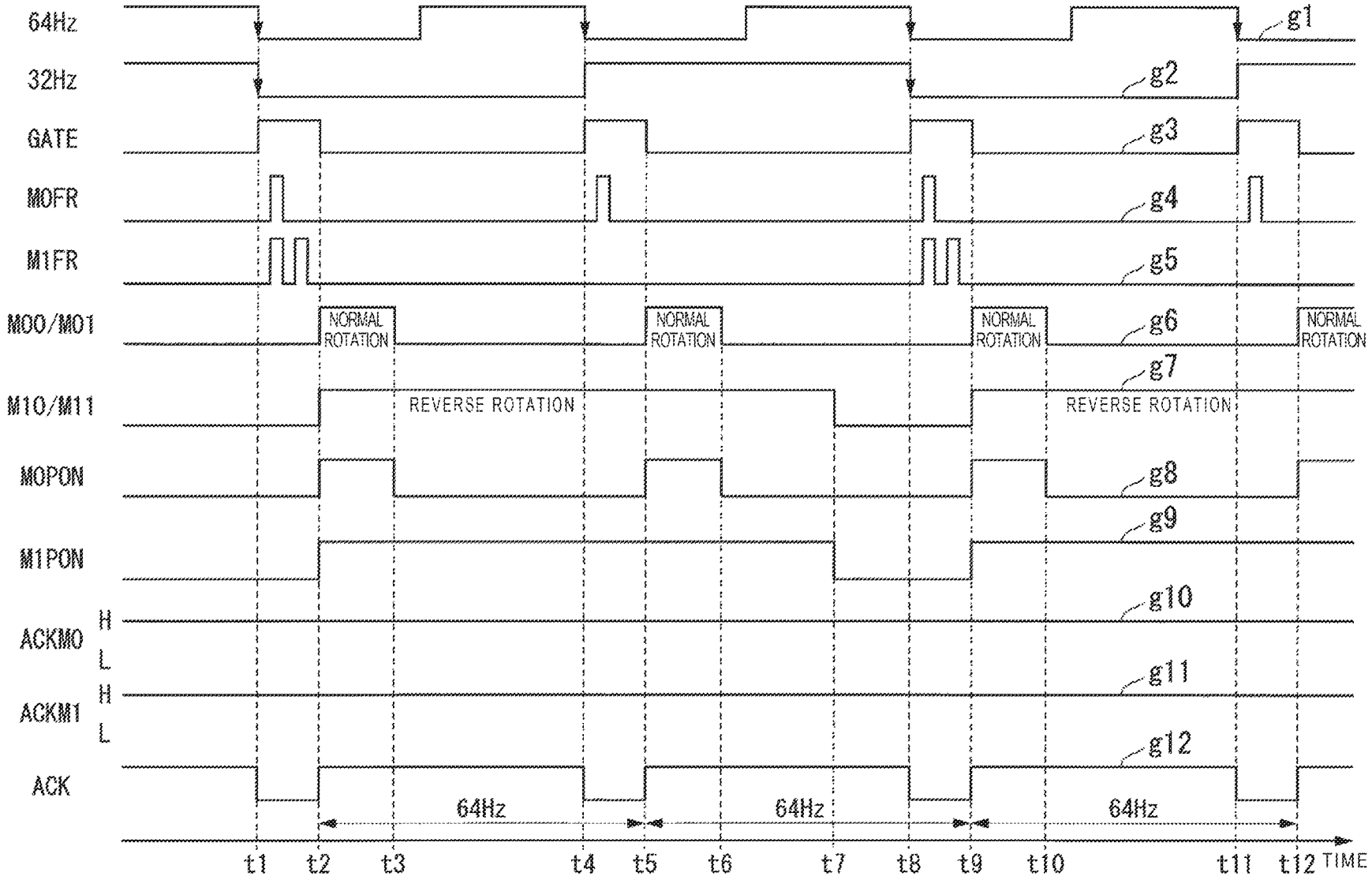
FIG. 3 illustrates an example of each timing of a GATE signal, an instruction signal, a pulse signal, an MnPON signal, an ACKMn signal, and an ACK signal according to the present embodiment.

FIG. 3 illustrates an example of the timing of the GATE signal, the instruction signal, the pulse signal, the MnPON signal, the ACKMn signal, and the ACK signal according to the present embodiment. In the example illustrated in FIG. 3, description will be made by using the M0FR signal and the M1FR signal and omitting the M2FR signal.

In FIG. 3, the horizontal axis represents the time, and the vertical axis represents whether each signal is in the H-level or the L-level. In addition, a waveform g1 is a waveform of a signal of 64 Hz obtained by a timer internally counted by the main control circuit 204. A waveform g2 is a waveform of a signal of 32 Hz obtained by the timer internally counted by the main control circuit 204. A waveform g3 is a waveform of the GATE signal. A waveform g4 is a waveform of the M0FR signal. A waveform g5 is a waveform of the M1FR signal. A waveform g6 indicates a drive state by using the pulse signals M00 and M01. A waveform g7 indicates a drive state by using the pulse signals M10 and M11. A waveform g8 is a waveform of the M0PON signal.

A waveform g9 is a waveform of the M1PON signal. A waveform g10 is a waveform of the ACKM0 signal. A waveform g11 is a waveform of the ACKM1 signal. A waveform g12 is a waveform of the ACK signal.

At time t1 which is the falling timing of 64 Hz and the falling timing of 32 Hz, the main control circuit 204 switches the GATE signal from the L-level to the H-level as in the waveform g3.

In addition, at time t1, the normal/reverse rotation determination circuit 45A sets the ACKM0 signal to be in the H-level of an initial value. The normal/reverse rotation determination circuit 45B sets the ACKM1 signal to be in the H-level of the initial value. The normal/reverse rotation determination circuit 45C sets the ACKM2 signal to be in the H-level of the initial value. The reception confirmation circuit 46 sets the ACK signal to be in the L-level of the initial value.

During times t1 to t2, as in the waveform g4, the main control circuit 204 outputs the M0FR signal of the instruction signal for causing the first motor 48A to perform the normal rotation for 1 clock (CLK) to the normal/reverse rotation determination circuit 45A. As in the waveform g5, the main control circuit 204 outputs the M1FR signal of the instruction signal for causing the second motor 48B to perform the reverse rotation for 2 CLKs to the normal/reverse rotation determination circuit 45B.

During times t1 to t2, the normal/reverse rotation determination circuit 45A confirms whether the M0PON signal is in the H-level or the L-level. Since the M0PON signal is in the L-level, the normal/reverse rotation determination circuit 45A determines that the first motor 48A is stopped (not driven), receives the instruction of the M0FR signal, and maintains the ACKM0 signal to be in the H-level of the initial value.

During times t1 to t2, the normal/reverse rotation determination circuit 45B confirms whether the M1PON signal is in the H-level or the L-level. Since the M1PON signal is in the L-level, the normal/reverse rotation determination circuit 45B determines that the second motor 48B is stopped, receives the instruction of the M1FR signal, and maintains the ACKM1 signal to be in the H-level of the initial value.

At time t2, as in the waveform g3, the main control circuit 204 switches the GATE signal from the H-level to the L-level.

At time t2, the normal/reverse rotation determination circuit 45A outputs an instruction to cause the normal rotation for one step to the drive pulse generation circuit 47A. The drive pulse generation circuit 47A drives the first motor 48A by generating the pulse signals M00 and M01 for causing the first motor 48A to perform the normal rotation for one step.

During times t2 to t3, as in the waveform g6, the first motor 48A performs the normal rotation for one step.

During times t2 to t3, as in the waveform g8, the drive pulse generation circuit 47A sets the M0PON signal to be in the H-level since first motor 48A is driven.

At time t2, the normal/reverse rotation determination circuit 45B outputs an instruction to perform the reverse rotation for one step to the drive pulse generation circuit 47B. The drive pulse generation circuit 47B drives the second motor 48B by generating the pulse signals M10 and M11 for causing the second motor 48B to perform the reverse rotation for one step.

During times t2 to t7, as in the waveform g7, the second motor 48B performs the reverse rotation for one step.

During times t2 to t7, as in the waveform g9, the drive pulse generation circuit 47B sets the M1PON signal to be in the H-level since the second motor 48B is driven.

In order to cause a single-phase stepping motor for driving the normal rotation to drive the reverse rotation by using pulse control, the normal rotation is driven at a signal cycle of 64 Hz from the length of the pulse, and the reverse rotation is driven at a signal cycle of 32 Hz.

At time t2, since both the ACKM0 signal and the ACKM1 signal are in the H-level, the reception confirmation circuit 46 sets the ACK signal to be in the H-level as in the waveform g12, and outputs the ACK signal to the main control circuit 204. Since the ACK signal is in the H-level, the main control circuit 204 determines that the instruction signals (the M0FR signal and the M1FR signal) are correctly accepted, that is, that each of the motors 48 is driven.

At time t4 which is the subsequent falling timing of 64 Hz and the rising timing of 32 Hz, as in the waveform g3, the main control circuit 204 switches the GATE signal from the L-level to the H-level.

During times t4 to t5, as in the waveform g4, the main control circuit 204 outputs the M0FR signal of the instruction signal for causing the first motor 48A to perform the normal rotation for 1 clock (CLK) to the normal/reverse rotation determination circuit 45A. Since it is defined that the reverse rotation takes a time of 32 Hz, the main control circuit 204 knows that the reverse rotation of the second motor 48B is not completed at time t4. Therefore, the main control circuit 204 does not output the M1FR signal serving as the instruction signal to the second motor 48B.

In addition, at time t4, the normal/reverse rotation determination circuit 45A sets the ACKM0 signal to be in the H-level of the initial value. The normal/reverse rotation determination circuit 45B sets the ACKM1 signal to be in the H-level of the initial value. The normal/reverse rotation determination circuit 45C sets the ACKM2 signal to be in the H-level of the initial value. The reception confirmation circuit 46 sets the ACK signal to be in the L-level of the initial value. That is, each time that the GATE signal rises, each circuit of the motor drive control unit 40 sets the ACKM0 signal to be in the H-level of the initial value, sets the ACKM1 signal to be in the H-level of the initial value, and sets the ACKM2 signal to be in the H-level of the initial value. The reception confirmation circuit 46 may switch the level at the rising timing of the GATE signal, or may switch the level at the falling timing of the GATE signal.

During times t4 to t5, the normal/reverse rotation determination circuit 45A confirms whether the M0PON signal is in the H-level or the L-level. Since the M0PON signal is in the L-level, the normal/reverse rotation determination circuit 45A determines that the first motor 48A is stopped, receives the instruction of the M0FR signal, and maintains the ACKM0 signal to be in the H-level of the initial value.

At time t5, as in the waveform g3, the main control circuit 204 switches the GATE signal from the H-level to the L-level.

At time t5, the normal/reverse rotation determination circuit 45A outputs an instruction to perform the normal rotation for one step to the drive pulse generation circuit 47A. The drive pulse generation circuit 47A drives the first motor 48A by generating the pulse signals M00 and M01 for causing the first motor 48A to perform the normal rotation for one step.

During times t5 to t6, as in the waveform g6, the first motor 48A performs the normal rotation for one step.

After time t8, the operation from time t1 to t7 is repeatedly performed.

As illustrated in FIG. 3, according to the present embodiment, even while the second motor 48B is driven (during the reverse rotation), the first motor 48A can be driven to perform the normal rotation at 64 Hz. In a case where the motor drive control unit 40 cannot receive the instruction signal until the second motor 48B is caused to perform the reverse rotation for one step and the second motor 48B is completely driven, while the second motor 48B is driven, the first motor 48A is driven to perform the normal rotation for one step. On the other hand, according to the present embodiment, even while the second motor 48B is driven, if the first motor 48A is stopped, the instruction signal is received. Therefore, while the second motor 48B is caused to perform the reverse rotation for one step, the first motor 48A can be caused to perform the normal rotation for two steps.

Next, a process example in a case where the instruction signal is received while the motor 48 is rotated will be described.

Figure 4:
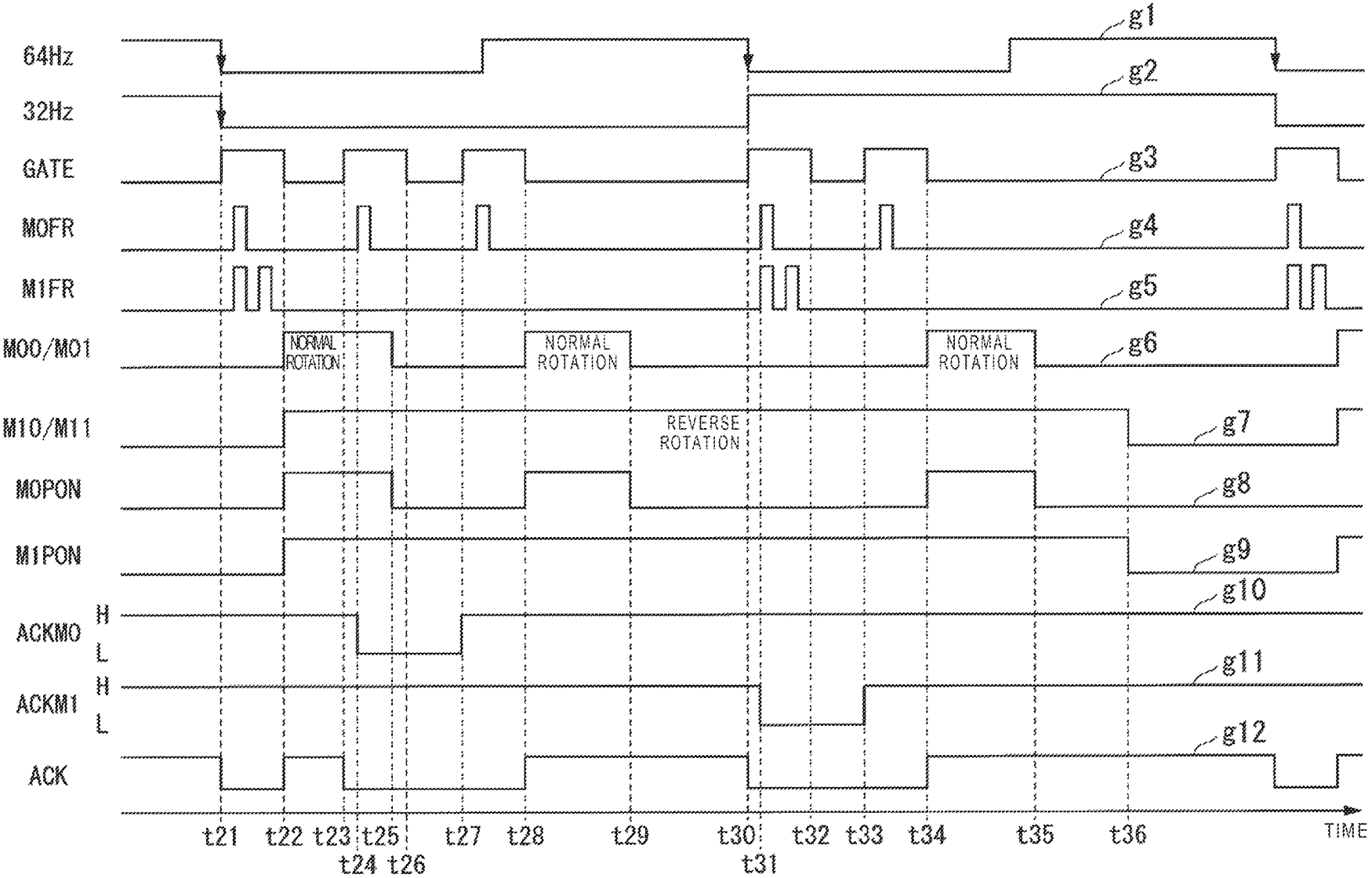
FIG. 4 illustrates an example of each timing in a case where the instruction signal is received while a motor is rotated according to the present embodiment.

FIG. 4 illustrates an example of each timing in a case where the instruction signal is received while the motor 48 is rotated according to the present embodiment. In FIG. 4, the horizontal axis represents the time, and the vertical axis represents whether each signal is in the H-level or the L-level. In addition, the waveform g1 to the waveform g12 are the same as those in FIG. 3.

At time t21 which is the falling timing of 64 Hz and the falling timing of 32 Hz, as in the waveform g3, the main control circuit 204 switches the GATE signal from the L-level to the H-level.

In addition, at time t21, the normal/reverse rotation determination circuit 45A sets the ACKM0 signal to be in the H-level of the initial value. The normal/reverse rotation determination circuit 45B sets the ACKM1 signal to be in the H-level of the initial value. The normal/reverse rotation determination circuit 45C sets the ACKM2 signal to be in the H-level of the initial value. The reception confirmation circuit 46 sets the ACK signal to be in the L-level of the initial value.

During times t21 to t22, as in the waveform g4, the main control circuit 204 outputs the M0FR signal of the instruction signal for causing the first motor 48A to perform the normal rotation for 1 clock (CLK) to the normal/reverse rotation determination circuit 45A. As in the waveform g5, the main control circuit 204 outputs the M1FR signal of the instruction signal for causing the second motor 48B to perform the reverse rotation for 2 CLKs to the normal/reverse rotation determination circuit 45B.

During times t21 to t22, the normal/reverse rotation determination circuit 45A confirms whether the M0PON signal is in the H-level or the L-level. Since the M0PON signal is in the L-level, the normal/reverse rotation determination circuit 45A determines that the first motor 48A is stopped, receives the instruction of the M0FR signal, and maintains the ACKM0 signal to be in the H-level of the initial value.

During times t21 to t22, the normal/reverse rotation determination circuit 45B confirms whether the M1PON signal is in the H-level or the L-level. Since the M1PON signal is in the L-level, the normal/reverse rotation determination circuit 45B determines that the second motor 48B is stopped, receives the instruction of the M1FR signal, and maintains the ACKM1 signal to be in the H-level of the initial value.

At time t22, as in the waveform g3, the main control circuit 204 switches the GATE signal from the H-level to the L-level.

At time t22, since both the ACKM0 signal and the ACKM1 signal are in the H-level, the reception confirmation circuit 46 sets the ACK signal to be in the H-level, and outputs the ACK signal to the main control circuit 204. Since the ACK signal is in the H-level, the main control circuit 204 determines that the instruction signals (the M0FR signal and the M1FR signal) are correctly accepted, that is, that each of the motors 48 is driven. In addition, the reception confirmation circuit 46 outputs an instruction to receive the instruction of the MnFR signal (n is an integer from 0 to 2) to the normal/reverse rotation determination circuit 45.

At time t22, since the instruction to receive the instruction of the MnFR signal is input from the reception confirmation circuit 46, the normal/reverse rotation determination circuit 45A accepts the instruction of the M0FR signal without discarding the instruction. That is, according to the present embodiment, when the GATE signal falls from the H-level to the L-level, the normal/reverse rotation determination circuit 45 determines whether or not to discard the instruction, based on the output of the reception confirmation circuit 46. The normal/reverse rotation determination circuit 45A outputs an instruction to perform the normal rotation for one step to the drive pulse generation circuit 47A. The drive pulse generation circuit 47A drives the first motor 48A by generating the pulse signals M00 and M01 for causing the first motor 48A to perform the normal rotation for one step.

During times t22 to t25, as in the waveform g6, the first motor 48A performs the normal rotation for one step.

During times t22 to t25, as in the waveform g8, the drive pulse generation circuit 47A sets the M0PON signal to be in the H-level since the first motor 48A is driven.

At time t22, since the instruction to receive the instruction of the MnFR signal is input from the reception confirmation circuit 46, the normal/reverse rotation determination circuit 45B accepts the instruction of the M1FR signal without discarding the instruction. At time t22, the normal/reverse rotation determination circuit 45B outputs the instruction to perform the reverse rotation for one step to the drive pulse generation circuit 47B. The drive pulse generation circuit 47B drives the second motor 48B by generating the pulse signals M10 and M11 for causing the second motor 48B to perform the reverse rotation for one step.

During times t22 to t36, as in the waveform g7, the second motor 48B performs the reverse rotation for one step.

During times t22 to t36, as in the waveform g9, the drive pulse generation circuit 47B sets the M1PON signal to be in the H-level since the second motor 48B is driven.

At time t23, as in the waveform g3, the main control circuit 204 switches the GATE signal from the L-level to the H-level.

In addition, at time t23, the normal/reverse rotation determination circuit 45A sets the ACKM0 signal to be in the H-level of the initial value. The normal/reverse rotation determination circuit 45B sets the ACKM1 signal to be in the H-level of the initial value. The normal/reverse rotation determination circuit 45C sets the ACKM2 signal to be in the H-level of the initial value. The reception confirmation circuit 46 sets the ACK signal to be in the L-level of the initial value.

During times t23 to t26, the main control circuit 204 outputs the M0FR signal of the instruction signal for causing the first motor 48A to perform the normal rotation for 1 clock (CLK) to the normal/reverse rotation determination circuit 45A as in the waveform g4.

During times t23 to t26, the normal/reverse rotation determination circuit 45A confirms whether the M0PON signal is in the H-level or the L-level.

At time t24 of receiving the M0FR signal serving as the instruction signal, since the M0PON signal is in the H-level, as in the waveform g10, the normal/reverse rotation determination circuit 45A sets the ACKM0 signal to be in the L-level.

At time t26, since the ACKM0 signal is in the L-level, the reception confirmation circuit 46 sets the ACK signal to be in the L-level, and outputs the ACK signal to the main control circuit 204. In addition, the reception confirmation circuit 46 outputs an instruction not to receive the instruction of the MnFR signal (n is an integer of 0 to 2) to the normal/reverse rotation determination circuit 45. The normal/reverse rotation determination circuit 45A discards the received instruction at time t26, and does not output the instruction to rotate the motor 48 to the drive pulse generation circuit 47A. As in the waveform g7, the second motor 48B is continuously driven even during times t23 to t26.

At time t26, as in the waveform g12, since the ACK signal is in the L-level, the main control circuit 204 determines that the M0FR signal is not accepted and the first motor 48A is not driven. The main control circuit 204 outputs the instruction signal again after reconstructing the instruction (correct instruction signal or correct output timing).

In the example in FIG. 4, during times t27 to t28, as in the waveform g4, the main control circuit 204 outputs the M0FR signal again to the motor drive control unit 40. During times t27 to t28, since the M0PON signal is in the L-level, the normal/reverse rotation determination circuit 45A receives the M0FR signal. Then, during the times t28 to t29, as in the waveform g6, the first motor 48A performs the normal rotation for one step.

Through the processes performed in this manner, the first motor 48A can perform the normal rotation for two steps at the time of 64 Hz even while the other motors 48 are driven.

During times t30 to t32, as in the waveform g4 and the waveform g5, the main control circuit 204 outputs the M0FR signal of the instruction to perform the normal rotation for one step and the M1FR signal to perform the reverse rotation for one step to the motor drive control unit 40.

During times t30 to t32, the normal/reverse rotation determination circuit 45A confirms whether the M0PON signal is in the H-level or the L-level. During times t30 to t32, the normal/reverse rotation determination circuit 45B confirms whether the M1PON signal is in the H-level or the L-level.

At time t31 of receiving the M0FR signal serving as the instruction signal, since the M1PON is in the H-level, as in the waveform g11, the normal/reverse rotation determination circuit 45B sets the ACKM1 signal to be in the L-level.

At time t32, since the ACKM1 signal is in the L-level, the reception confirmation circuit 46 sets the ACK signal to be in the L-level, and outputs the ACK signal to the main control circuit 204. In addition, the reception confirmation circuit 46 outputs the instruction not to receive the instruction of the MnFR signal to the normal/reverse rotation determination circuit 45. The normal/reverse rotation determination circuit 45B discards the received instruction, and does not output the instruction to rotate the motor 48 to the drive pulse generation circuit 47B. As in the waveform g7, the second motor 48B is continuously driven even during times t30 to t32.

At time t32, since the ACK signal is in the L-level, the main control circuit 204 determines that the first motor 48A is not driven. As in the waveform g4, the main control circuit 204 outputs the instruction signal again after reconstructing the instruction (correct instruction signal or correct output timing).

During times t33 to t34, the main control circuit 204 outputs the M0FR signal of the instruction to perform the normal rotation for one step to the motor drive control unit 40.

During times t33 to t34, the M0PON signal is in the L-level. Accordingly, during the times t34 to t35, as in the waveform g6, the first motor 48A performs the normal rotation for one step.

At time t34, since both the ACKM0 signal and the ACKM1 signal are in the H-level, the reception confirmation circuit 46 sets the ACK signal to be in the H-level, and outputs the ACK signal to the main control circuit 204. Since the ACK signal is in the H-level, the main control circuit 204 determines that the M0FR signal is correctly accepted.

Next, an output procedure of the MnFR (n is an integer of 0 to 1) signal of the main control circuit 204 will be described.

Figure 5:
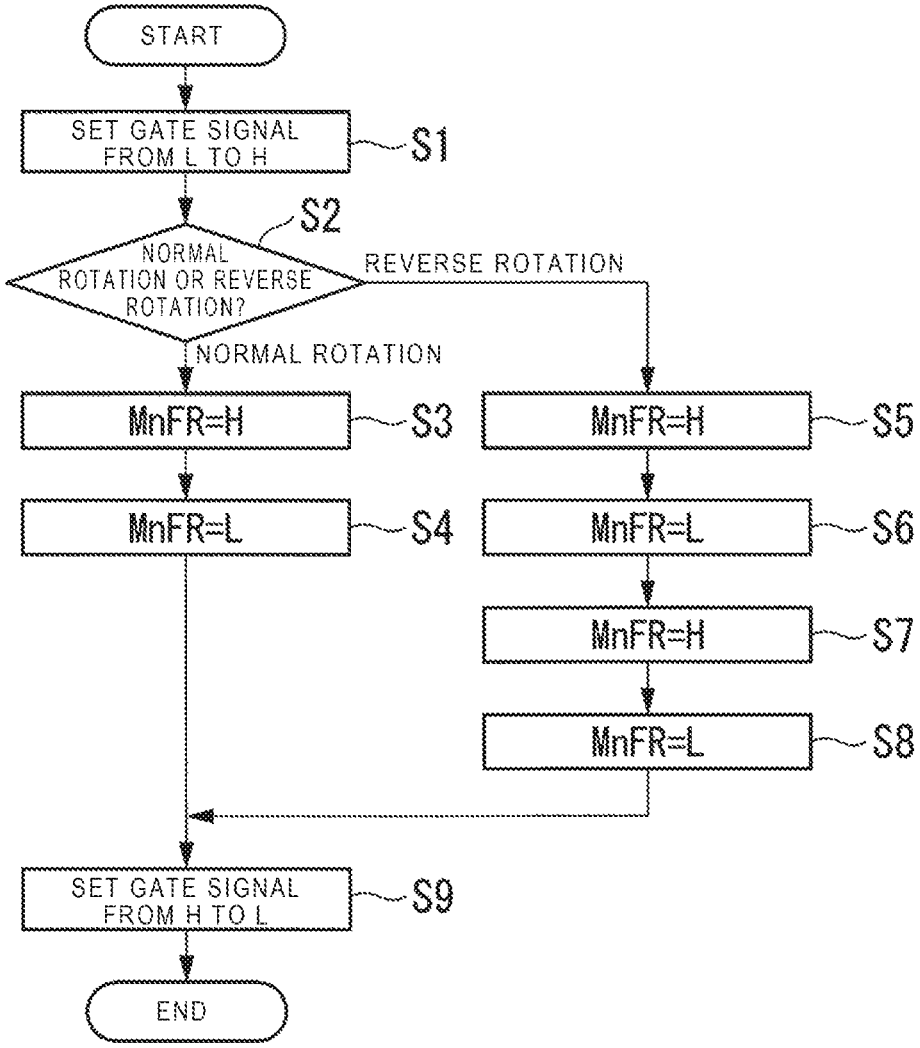
FIG. 5 is a flowchart of an output of an MnFR signal of a main control circuit according to the present embodiment.

FIG. 5 is a flowchart of an output of the MnFR signal of the main control circuit 204 according to the present embodiment.

(Step S1) The main control circuit 204 switches the GATE signal from the L-level to the H-level.

(Step S2) The main control circuit 204 determines whether to cause the first motor 48A to perform the normal rotation or the reverse rotation. In a case where the main control circuit 204 determines to cause the first motor 48A to perform the normal rotation (Step S2; the normal rotation), the main control circuit 204 proceeds to the process in Step S3. In a case where the main control circuit 204 determines to cause the first motor 48A to perform the reverse rotation (Step S2; the reverse rotation), the process proceeds to Step S5.

(Step S3) The main control circuit 204 sets the MnFR signal to be in the H-level for a predetermined period of time.

(Step S4) The main control circuit 204 sets the MnFR signal to be in the L-level, and proceeds to the process in Step S9. That is, the main control circuit 204 outputs one pulse of the H-level to the MnFR signal during the normal rotation.

(Step S5) The main control circuit 204 sets the MnFR signal to be in the H-level for a predetermined period of time.

(Step S6) The main control circuit 204 sets the MnFR signal to be in the L-level for a predetermined period of time.

(Step S7) The main control circuit 204 sets the MnFR signal to be in the H-level for a predetermined period of time.

(Step S8) The main control circuit 204 sets the MnFR signal to be in the L-level, and proceeds to the process in Step S9. That is, the main control circuit 204 outputs two pulses of the H-level to the MnFR signal during the reverse rotation.

(Step S9) The main control circuit 204 switches the GATE signal from the H-level to the L-level.

Next, an example of a process procedure of the main control circuit 204 will be described.

Figure 6:
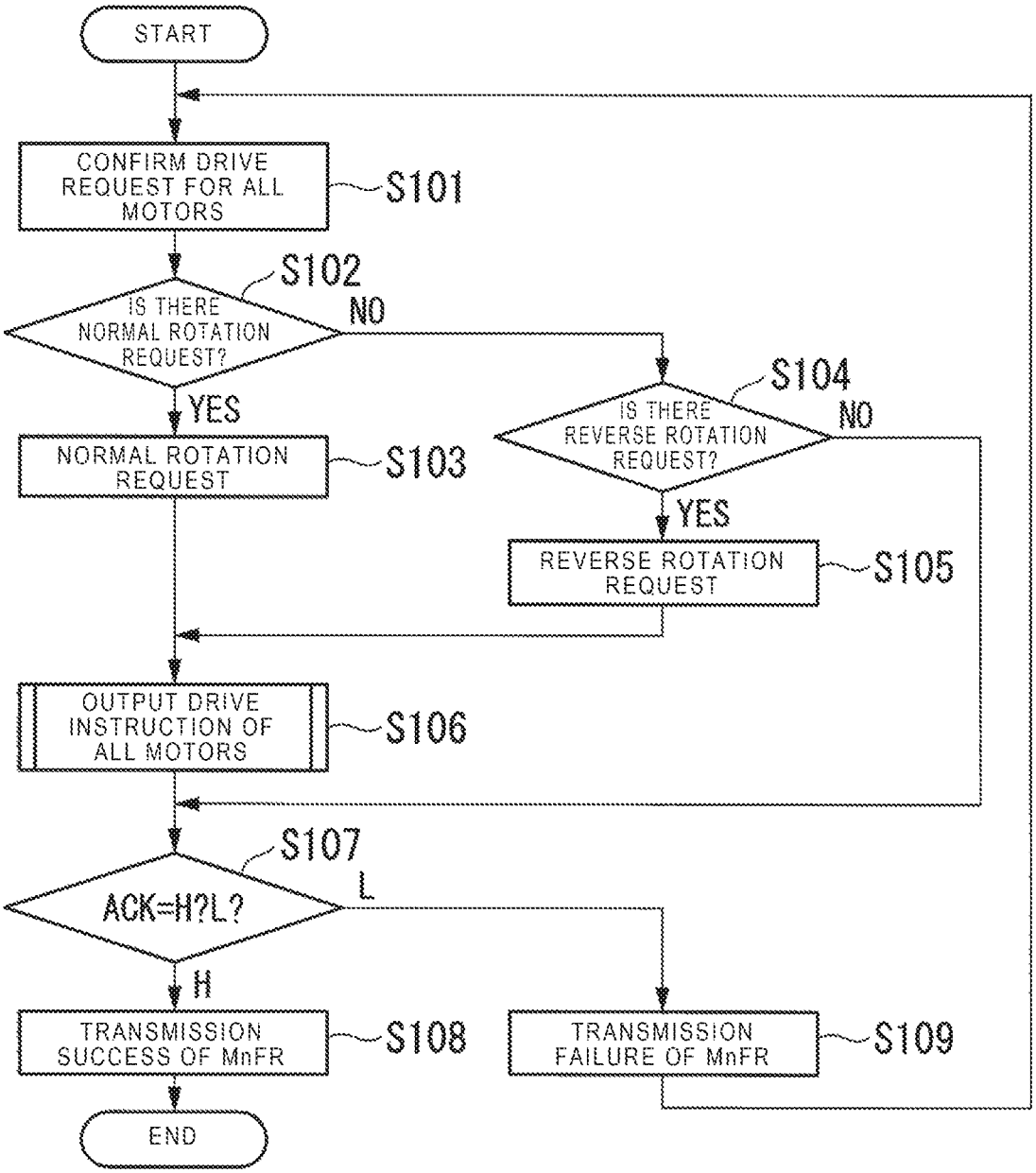
FIG. 6 is a flowchart of a process of the main control circuit according to the present embodiment.

FIG. 6 is a flowchart of the process of the main control circuit 204 according to the present embodiment.

(Step S101) The main control circuit 204 confirms the drive request for all of the motors 48.

The main control circuit 204 performs Step S102 to Step S105 described below for each of the motors 48.

(Step S102) The main control circuit 204 determines whether or not the drive request for the motor 48 is a normal rotation request. In a case where the main control circuit 204 determines that the drive request for the motor 48 is the normal rotation request (Step S102; YES), the main control circuit 204 proceeds to the process in Step S103. In a case where the main control circuit 204 determines that the drive request for the motor 48 is not the normal rotation request (Step S102; NO), the main control circuit 204 proceeds to the process in Step S104.

(Step S103) The main control circuit 204 generates the instruction signal of the normal rotation request, and proceeds to the process in Step S106.

(Step S104) The main control circuit 204 determines whether or not the drive request for the motor 48 is the reverse rotation request. In a case where the main control circuit 204 determines that the drive request for the motor 48 is the reverse rotation request (Step S104; YES), the main control circuit 204 proceeds to the process in Step S105. In a case where it is determined that the drive request for the motor 48 is not the reverse rotation request (Step S104; NO), the main control circuit 204 proceeds to the process in Step S107.

(Step S105) The main control circuit 204 generates the instruction signal of the reverse rotation request, and proceeds to the process in Step S106.

(Step S106) Through the processes in Step S1 to Step S9 in FIG. 5, the main control circuit 204 outputs the MnFR signal of the instruction signal, which is the drive request for all of the motors 48, to the motor drive control unit 40. As illustrated in FIGS. 3 and 4, the main control circuit 204 outputs a plurality of the MnFR signals at the same time.

(Step S107) The main control circuit 204 determines whether the ACK signal is in the H-level or the L-level. In a case where the main control circuit 204 determines that the ACK signal is in the L-level (Step S107; L), the main control circuit 204 proceeds to the process in Step S109. In a case where it is determined that the ACK signal is in the H-level (Step S107; H), the main control circuit 204 proceeds to the process in Step S108.

(Step S108) The main control circuit 204 determines that the MnFR signal is successfully transmitted, and completes the process.

(Step S109) The main control circuit 204 determines that the MnFR signal fails to be transmitted, clears all drive requests, returns to the process in Step S101, and transmits the instruction signal again.

Next, an example of a process procedure of the motor drive control unit 40 will be described.

Figure 7:
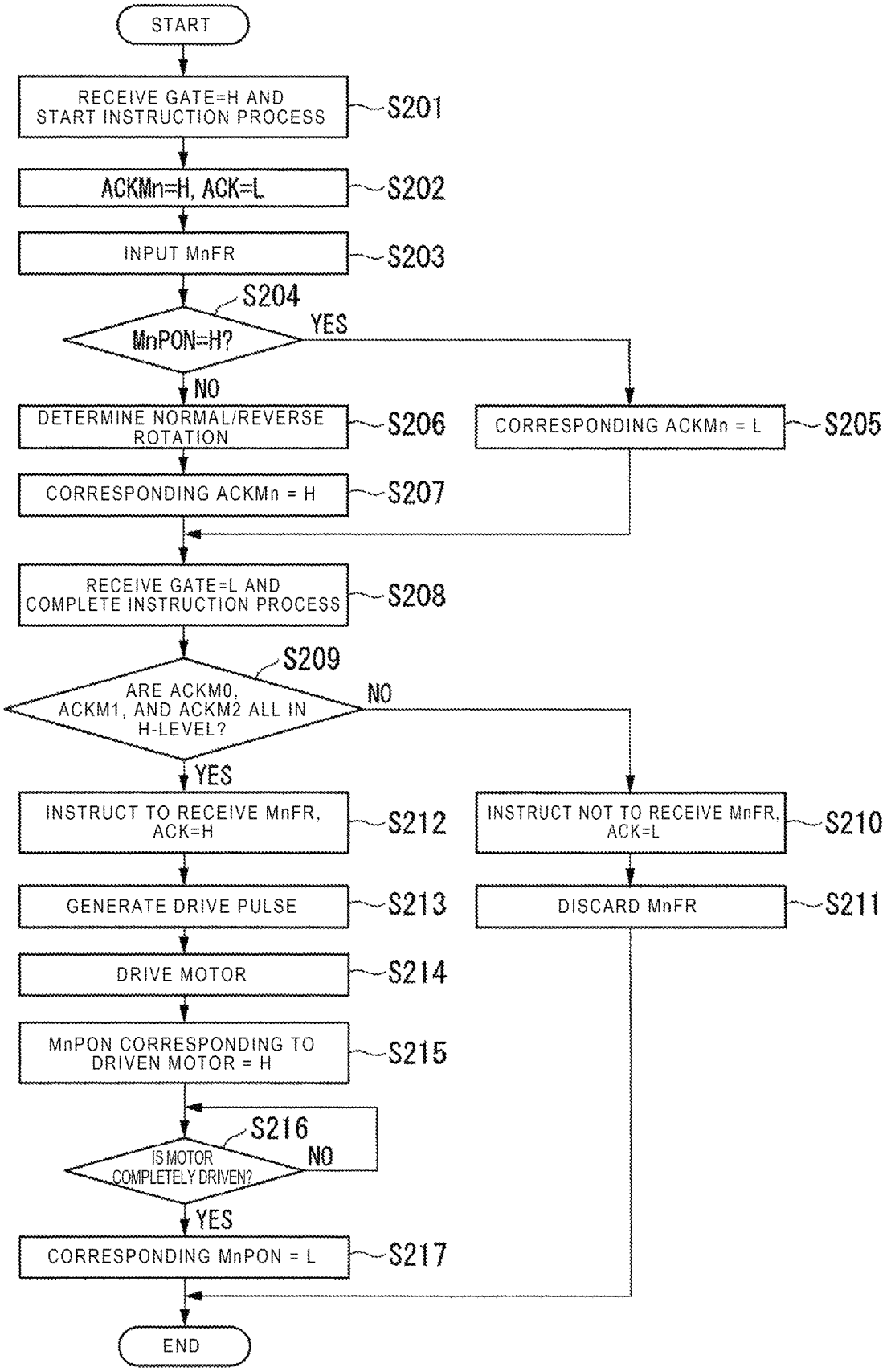
FIG. 7 is a flowchart of a process of a motor drive control unit according to the present embodiment.

FIG. 7 is a flowchart of the process of the motor drive control unit 40 according to the present embodiment.

(Step S201) When the GATE signal output from the main control unit 20 is switched from the L-level to the H-level, the motor drive control unit 40 starts to perform the process instructed from the main control unit 20.

(Step S202) The motor drive control unit 40 sets the ACKMn (n is an integer of 0 to 1) signal to be in the H-level of the initial value, and sets the ACK signal to be in the L-level of the initial value.

(Step S203) During a period while the GATE signal is in the H-level, the MnFR signal serving as the instruction signal is input to the normal/reverse rotation determination circuit 45.

The motor drive control unit 40 performs the processes in Step S204 to Step S207 and Step S212 to Step S217 described below for each of the motors 48.

(Step S204) When the MnFR signal is input, a normal/reverse rotation determination circuit 45*n* determines whether or not the MnPON signal is in the H-level. In a case where the normal/reverse rotation determination circuit 45*n* determines that the MnPON signal is in the H-level (Step S204; YES), the normal/reverse rotation determination circuit 45*n* proceeds to the process in Step S205. In a case where the normal/reverse rotation determination circuit 45*n* determines that the MnPON signal is not in the H-level (Step S204; NO), the normal/reverse rotation determination circuit 45*n* proceeds to the process in Step S206.

(Step S205) The normal/reverse rotation determination circuit 45*n* sets the corresponding ACKMn signal to be in the L-level, and proceeds to the process in Step S208.

(Step S206) The normal/reverse rotation determination circuit 45*n* determines whether the input MnFR signal is the normal rotation instruction or the reverse rotation instruction, and proceeds to the process in Step S207.

(Step S207) The normal/reverse rotation determination circuit 45*n* sets the corresponding ACKMn signal to be in the H-level, and proceeds to the process in Step S208.

(Step S208) When the GATE signal is switched from the H-level to the L-level, the motor drive control unit 40 completes the process instructed from the main control unit 20.

(Step S209) The reception confirmation circuit 46 determines whether or not the ACKM0 signal output by the normal/reverse rotation determination circuit 45A, the ACKM1 signal output by the normal/reverse rotation determination circuit 45B, the ACKM2 signal output by the normal/reverse rotation determination circuit 45C are all in the H-level. In a case where all are in the H-level (Step S209; YES), the reception confirmation circuit 46 proceeds to the process in Step S212. In a case where at least one is in the L-level (Step S209; NO), the reception confirmation circuit 46 proceeds to the process in Step S210.

(Step S210) The reception confirmation circuit 46 outputs the instruction not to receive the instruction of the MnFR signal to the normal/reverse rotation determination circuit 45*n*, and sets the ACK signal to be in the L-level. The reception confirmation circuit 46 proceeds to the process in Step S211.

(Step S211) The normal/reverse rotation determination circuit 45*n* does not receive and discards the input MnFR signal instruction. That is, the normal/reverse rotation determination circuit 45*n* does not accept the instruction, and does not drive the motor 48. The normal/reverse rotation determination circuit 45*n* completes the process.

(Step S212) The reception confirmation circuit 46 outputs an instruction to receive the instruction of the MnFR signal to the normal/reverse rotation determination circuit 45*n*, and sets the ACK signal to be in the H-level. The reception confirmation circuit 46 proceeds to the process in Step S213.

(Step S213) The normal/reverse rotation determination circuit 45*n* receives the MnFR signal, and outputs the instruction to rotate the motor 48 one step to the corresponding drive pulse generation circuit 47*n*. Subsequently, the drive pulse generation circuit 47*n* generates the pulse signal for causing the motor 48 to perform the normal rotation or the reverse rotation for one step in response to the MnFR signal.

(Step S214) The drive pulse generation circuit 47*n* starts to drive the corresponding motor 48*n*.

(Step S215) The drive pulse generation circuit 47*n* sets the corresponding MnPON signal to be in the H-level.

(Step S216) The drive pulse generation circuit 47*n* determines whether or not the motor 48*n* is completely driven, based on whether or not the pulse signal is completely output. In a case where the drive pulse generation circuit 47*n* determines that the motor 48*n* is not completely driven (Step S216; NO), the process in Step S216 is repeatedly performed. In a case where the drive pulse generation circuit

47*n* determines that the motor 48*n* is completely driven (Step S216; YES), the drive pulse generation circuit 47*n* proceeds to the process in Step S217.

(Step S217) The drive pulse generation circuit 47*n* sets the corresponding MnPON signal to be in the L-level, and completes the process.

As illustrated in FIGS. 4 to 7, if the ACK signal output by the motor drive control unit 40 is in the H-level, the main control circuit 204 determines that the transmitted instruction signal is correctly accepted. Then, if the ACK signal is in the L-level, the main control circuit 204 determines that the transmitted instruction signal is not received, and transmits the instruction signal again to the motor drive control unit 40.

Then, when any one of the ACKMn (n is an integer from 0 to 2) signals is in the L-level, that is, in a case where the normal/reverse rotation determination circuit 45 receives the instruction signal while the motor 48 is driven, the reception confirmation circuit 46 instructs the normal/reverse rotation determination circuit 45 to discard the instruction received at that time. In this manner, the normal/reverse rotation determination circuit 45 discards the received instruction signal, and does not newly drive the motor 48.

According to the present embodiment, in a case of performing driving control on a plurality of the motors 48, the main control circuit 204 can recognize a situation as to which one of the motors 48 is successfully driven or fails to be driven by using the ACK signal. In this manner, according to the present embodiment, the motor control signal can be generated and transmitted reflecting the situation. According to the present embodiment, as illustrated in FIG. 3, for example, even during a period while one of the motors 48 is reversely rotated at 32 Hz, the normal rotation instruction can be accepted twice, that is, the normal rotation can be controlled with a cycle of 64 Hz. In addition, according to the present embodiment, as illustrated in FIG. 4, the normal rotation can be performed twice or more within a period of the cycle of 64 Hz.

A program for entirely or partially realizing the functions of the main control unit 20 or the motor drive control unit 40 according to the present invention may be recorded in a computer-readable recording medium. The program recorded in the recording medium may be read and executed by a computer system so that the processes performed by the main control unit 20 or the motor drive control unit 40 may be performed. The "computer system" described herein includes OS or hardware of peripheral devices. In addition, the "computer system" also includes a WWW system provided with a homepage providing environment (or display environment). The "computer-readable recording medium" means a portable medium such as a flexible disk, a magneto-optical disk, a ROM, and a CD-ROM, or a storage medium such as a hard disk incorporated in the computer system. Furthermore, the "computer-readable recording medium" includes those which hold the program for a certain period of time, such as a volatile memory (RAM) inside the computer system serving as a server or a client in a case where the program is transmitted via a network such as the Internet or a communication line such as a telephone line.

In addition, the above-described program may be transmitted from the computer system having the program stored in the storage device to another computer system via a transmission medium or by using a transmission wave in the transmission medium. Herein, the "transmission medium" for transmitting the program means a medium having a function to transmit information as in a network (communication network) such as the Internet or a communication line (communication cable) such as a telephone line. In addition, the above-described program may partially realize the above-described functions. Furthermore, the above-described program may be a so-called difference file (difference program) which can realize the above-described functions in combination with the program previously recorded in the computer system.

What is claimed is:

1. A timepiece comprising:

a motor control unit driving a motor for driving an indicating hand, based on an instruction signal; and a control unit receiving an instruction confirmation signal corresponding to a drive state of the motor in response to the instruction signal from the motor control unit, and determining whether or not the motor is driven in accordance with the instruction signal, based on the instruction confirmation signal, wherein the motor control unit includes a motor drive state determination circuit determining the drive state of the motor, and an instruction confirmation circuit generating an instruction confirmation signal, wherein in a case where the motor is driven and the instruction signal is input to the motor, the instruction confirmation circuit generates a first instruction confirmation signal, wherein in a case where the motor is not driven and the instruction signal is input to the motor, or in a case where the motor is driven or is not driven and the instruction signal is not input to the motor, the instruction confirmation circuit generates a second instruction confirmation signal, and wherein in a case where the control unit receives the first instruction confirmation signal, the control unit determines that the motor is not driven in accordance with the instruction signal.

2. The timepiece according to claim 1, wherein the motor control unit drives a plurality of the motors, wherein the instruction signal is a command for driving a plurality of the motors, and wherein the motor control unit generates the instruction confirmation signal corresponding to each drive state of a plurality of the motors in response to the instruction signal.

3. The timepiece according to claim 1, wherein the motor control unit drives a plurality of the motors, wherein the instruction signal is a command for driving the plurality of motors, and wherein the motor control unit includes a motor drive state determination circuit determining the drive state of the motor, and an instruction confirmation circuit generating an instruction confirmation signal, wherein in a case where the motors are driven and the instruction signal is input to any one motor of a plurality of the motors, the instruction confirmation circuit generates a first instruction confirmation signal, wherein in a case where the motors are not driven and the instruction signal is input to all motors of a plurality of the motors, or in a case where at least one of the motors is driven or is not driven and the instruction signal is not input to the motor, the instruction confirmation circuit generates a second instruction confirmation signal, and wherein in a case where the control unit receives the first instruction confirmation signal, the control unit determines that at least one of a plurality of the motors is not driven due to the command.

4. The timepiece according to claim 1, wherein the instruction signal includes information relating to a type of the motor to be driven and a direction for driving the indicating hand, and wherein at least one of the control unit and the motor control unit includes a drive pulse generation circuit that sets a drive frequency so as to vary depending on any one of the type of the motor and the direction for driving the indicating hand.

5. The timepiece according to claim 1, wherein the motor control unit is included in a support body separate from the control unit and detachably attached to the timepiece.

6. The timepiece according to claim 1, wherein the instruction confirmation signal is connected via a single wire connected to the control unit and the motor control unit.

7. The timepiece according to claim 1, wherein the control unit outputs a gate signal allowing the instruction signal, and wherein the motor control unit generates the instruction confirmation signal in response to at least one of a start time and an end time of the gate signal.

8. A motor control device comprising:

a motor drive state determination circuit determining a drive state of a motor; and an instruction confirmation circuit generating an instruction confirmation signal indicating a state where the motor is driven based on an instruction signal, wherein in a case where the motor is driven and the instruction signal is input to the motor, the instruction confirmation circuit generates a first reception confirmation signal, and wherein in a case where the motor is not driven and the instruction signal is input to the motor, or in a case where the motor is driven or is not driven and the instruction signal is not input to the motor, the instruction confirmation circuit generates a second reception confirmation signal.

9. A motor control method of a motor control device including a motor drive state determination circuit determining a drive state of a motor, and an instruction confirmation circuit generating an instruction confirmation signal indicating a state where the motor is driven based on an instruction signal, the method comprising:

causing the instruction confirmation circuit to generate a first reception confirmation signal, in a case where the motor is driven and the instruction signal is input to the motor; and causing the instruction confirmation circuit to generate a second reception confirmation signal, in a case where the motor is not driven and the instruction signal is input to the motor, or in a case where the motor is driven or is not driven and the instruction signal is not input to the motor.

* * * * *